US008998072B2

(12) United States Patent
Whittles et al.

(10) Patent No.: US 8,998,072 B2
(45) Date of Patent: Apr. 7, 2015

(54) FOLDABLE CONTAINERS

(71) Applicants: C.H. Robinson Worldwide, Inc., Eden Prairie, MN (US); Coroplast, Inc., Vanceburg, KY (US)

(72) Inventors: Daniel J. Whittles, Lake Worth, FL (US); David Olds, Vanceburg, KY (US)

(73) Assignees: C.H. Robinson Worldwide, Inc., Eden Prairie, MN (US); Coroplast, Inc., Vanceburg, KY (US)

( * ) Notice: Subject to any disclaimer, the term of this patent is extended or adjusted under 35 U.S.C. 154(b) by 29 days.

(21) Appl. No.: 13/936,928

(22) Filed: Jul. 8, 2013

(65) Prior Publication Data

US 2014/0008262 A1 Jan. 9, 2014

Related U.S. Application Data

(60) Provisional application No. 61/668,816, filed on Jul. 6, 2012.

(51) Int. Cl.

| | |
|---|---|
| ***B65D 5/10*** | (2006.01) |
| ***B65D 1/40*** | (2006.01) |
| ***B65D 5/02*** | (2006.01) |
| ***B65D 5/00*** | (2006.01) |
| ***B65D 21/02*** | (2006.01) |
| ***B65D 71/36*** | (2006.01) |

(52) U.S. Cl.
CPC .. *B65D 1/40* (2013.01); *B65D 5/10* (2013.01); *B65D 5/0254* (2013.01); *B65D 5/001* (2013.01); *B65D 21/0212* (2013.01); *B65D 71/36* (2013.01)

(58) Field of Classification Search
CPC ..... B65D 5/001; B65D 5/10; B65D 5/0254; B65D 21/0212; B65D 71/36
USPC ..... 229/157, 185, 915, 916
See application file for complete search history.

(56) References Cited

U.S. PATENT DOCUMENTS

| | | | | |
|---|---|---|---|---|
| 4,279,379 | A * | 7/1981 | Lohrbach et al. | 229/185 |
| 4,583,678 | A * | 4/1986 | Weimer, Jr. | 229/185 |
| 4,884,741 | A * | 12/1989 | Nederveld | 229/157 |
| 5,046,662 | A * | 9/1991 | Cowles | 229/157 |
| 5,305,950 | A * | 4/1994 | Oppenheim | 229/157 |
| 5,318,220 | A * | 6/1994 | Gagliardo | 229/157 |
| 8,622,282 | B2 * | 1/2014 | Brundage et al. | 229/157 |
| 2002/0011513 | A1 * | 1/2002 | Dowd | 229/157 |
| 2004/0211825 | A1 * | 10/2004 | Champion et al. | 229/157 |
| 2005/0087590 | A1 * | 4/2005 | Kawagoe et al. | 229/157 |
| 2006/0163333 | A1 * | 7/2006 | Kornacki | 229/157 |

* cited by examiner

*Primary Examiner* — Gary Elkins
(74) *Attorney, Agent, or Firm* — Phillips Ryther & Winchester; Matthew D. Thayne

(57) ABSTRACT

Embodiments of foldable containers, such as foldable, plastic, produce containers, and related methods. In some embodiments, a substantially planar sheet for folding into a three-dimensional container may be provided comprising a plurality of side portions, each side portion comprising opposing flaps positioned on opposite sides. Each of the side portions may comprise opposing flaps, some of which may comprise tabs extending therefrom to be used for coupling with an adjacent side portion during a folding process. One or more of the side portions may also, or alternatively, comprise a stacking tab and/or a stacking tab receiving opening. The stacking tabs may be configured to be positioned within a stacking tab receiving opening of an adjacent container after the sheet has been folded into a three-dimensional container.

20 Claims, 2 Drawing Sheets

FOLDABLE CONTAINERS

RELATED APPLICATIONS

This application claims the benefit under 35 U.S.C. §119 (e) of U.S. Provisional Patent Application No. 61/668,816 filed Jul. 6, 2012 and titled "PLASTIC PRODUCE CONTAINERS," which application is incorporated herein by reference in its entirety.

SUMMARY

Embodiments of foldable containers, such as foldable, plastic, produce containers, are disclosed herein, along with implementations of related methods. In some embodiments, a substantially planar sheet for folding into a three-dimensional container may be provided. In some embodiments, a substantially planar sheet for folding into a three-dimensional container may be provided comprising a plurality of side portions, each side portion comprising opposing flaps positioned on opposite sides. Each of the side portions may comprise opposing flaps, some of which may comprise tabs extending therefrom to be used for coupling with an adjacent side portion during a folding process. One or more of the side portions may also, or alternatively, comprise a stacking tab and/or a stacking tab receiving opening. The stacking tabs may be configured to be positioned within a stacking tab receiving opening of an adjacent container after the sheet has been folded into a three-dimensional container.

In a more specific example of an embodiment of a foldable sheet, the sheet may comprise a first side portion comprising opposing flaps positioned on opposite sides of the first side portion. The opposing flaps of the first side portion may each comprise at least one tab extending therefrom.

In some embodiments, a second side portion may be positioned adjacent to the first side portion. The second side portion may comprise opposing flaps positioned on opposite sides of the second side portion, and the opposing flaps of the second side portion may also further comprise at least one tab receiving opening configured to receive a tab from the first side portion. In some embodiments, the second side portion may further comprise at least one stacking tab and at least one stacking tab receiving opening.

Some embodiments may further comprise a third side portion positioned adjacent to the second side portion. The third side portion may comprise opposing flaps positioned on opposite sides of the third side portion and the opposing flaps of the third side portion may also each comprise at least one tab extending therefrom.

Some embodiments may further comprise a fourth side portion positioned adjacent to the third side portion and comprising opposing flaps positioned on opposite sides of the fourth side portion. The opposing flaps of the fourth side portion may each comprise at least one tab receiving opening configured to receive a tab from the third side portion.

The substantially planar sheet may be configured to be folded into a three-dimensional container. In embodiments comprising stacking tabs, the stacking tab(s) may be configured to be positioned within a stacking tab receiving opening of an adjacent container after the sheet has been folded into a three-dimensional container. Similarly, the stacking tab receiving opening(s) may be configured to receive a stacking tab of an adjacent container after the sheet has been folded into a three-dimensional container.

In some embodiments, the sheet may comprise corrugated plastic, such that the resulting container comprises a corrugated plastic container. As discussed below, such containers may be particularly useful for produce, including corn, for example.

In some embodiments, the sheet may further comprise one or more folding lines to facilitate folding of the sheet into a container. Such folding lines may comprise score lines or other such lines configured to facilitate folding. Thus, some embodiments may comprise a first folding line positioned between the first side portion and the second side portion, a second folding line positioned between the second side portion and the third side portion, and a third folding line positioned between the third side portion and the fourth side portion. In some embodiments, the sheet may be configured to be folded into a three-dimensional container without the use of any adhesives or other bonding techniques.

Some embodiments may further comprise one or more handle structures. For example, some embodiments may comprise a first handle structure and a second handle structure. The first handle structure may be positioned on a side portion of the sheet opposite from a side portion of the sheet on which the second handle structure is positioned. One or more of the handle structures may comprise a first handle opening portion and a first handle member portion.

In another specific example of an embodiment of the invention, a corrugated produce box may be provided comprising a first flap comprising a first tab extending from the first flap, and a second flap adjacent to the first flap and comprising a first tab receiving opening configured to receive the first flap. The first tab receiving opening may comprise an indentation, such as a notch extending into the opening. The indentation may be configured to facilitate improved securement of the first tab within the first tab receiving opening. In order to do so, the indentation may comprise a first side extending along an at least substantially straight line towards an outer side of the first tab receiving opening at an angle greater than ninety degrees. In some embodiments, the angle may be between about 91 degrees and about 100 degrees. In some such embodiments, the angle may be between about 92 degrees and about 98 degrees. In some preferred embodiments, the angle may be about 95 degrees.

As shown in the drawings and discussed in greater detail below, the outer side of the tab receiving opening(s) may comprise a straight line. And, in some embodiments, the indentation may further comprise a second side adjacent to the first side. The second side may comprise a concave, curved line that extends towards and joins with the outer side of the first tab receiving opening.

In still another specific example of an embodiment of the invention, a substantially planar sheet for folding into a container may comprise a first side portion comprising opposing flaps positioned on opposite sides of the first side portion, wherein the opposing flaps of the first side portion each comprises at least one tab portion extending therefrom. The sheet may further comprise a second side portion positioned adjacent to the first side portion and comprising opposing flaps positioned on opposite sides of the second side portion, wherein the opposing flaps of the second side portion each comprises at least one tab receiving opening configured to receive a tab portion of the first side portion therein. In some embodiments, at least one of the tab portions of the first side portion may extend further from the first side portion than an adjacent flap of the second side portion.

Some embodiments may further comprise a third side portion positioned adjacent to the second side portion and comprising opposing flaps positioned on opposite sides of the third side portion. The opposing flaps of the third side portion may also both comprise at least one tab portion extending therefrom. Similarly, a fourth side portion may be positioned adjacent to the third side portion and may comprise opposing flaps positioned on opposite sides of the fourth side portion. The opposing flaps of the fourth side portion may each comprise at least one tab receiving opening configured to receive a tab portion from the third side portion therein.

In some embodiments, at least one of the tab portions of the third side portion may extend further from the third side portion than an adjacent flap of the fourth side portion. In some embodiments, a first tab portion of the first side portion may extend further from the first side portion than an adjacent flap of the second side portion, but a second tab portion extending from an opposite side of the first side portion relative to the first tab portion does not extend further from the first side portion than an adjacent flap of the second side portion. Similarly, in some embodiments, a first tab portion of the third side portion may extend further from the third side portion than an adjacent flap of the fourth side portion, but a second tab portion extending from an opposite side of the third side portion relative to the first tab portion of the third side portion does not extend further from the third side portion than an adjacent flap of the fourth side portion.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Crates, cartons, boxes, and other storage containers are widely used in the harvesting, storage, and transport of produce, including corn. For example, after harvesting, ears of corn are commonly placed in wood and wire crates for post-harvest cooling, storage and transport. Wood and wire crates, however, have a number of significant drawbacks. For example, they can be cumbersome to assemble and/or handle and are susceptible to breakage through the supply chain, thereby slowing the harvesting/packaging/shipping processes. They are also susceptible to mold and spore growth in moist environments (which can be transferred to the corn or produce), and are relatively heavy. Additionally, the use of wood and wire crates poses certain handling risks, including cuts from sharp corners/wires and splinters. As such, workers at both the field and packing level, as well as at the receiving end, often need gloves to assemble, pack, or otherwise handle such crates. Such crates are also often cited as the most injury causing item in a distribution center, warehouse, or store. In addition, wire-bound wooden crates are one of the least sustainable materials in use for containers and are often burned or dumped at a landfill.

Wax-coated corrugated cardboard storage containers provide certain benefits over wood and wire crates, but are often not generally constructed of post-consumer materials, which are typically not recyclable or otherwise sustainable throughout the supply chain. These containers also often have certain durability issues. For these reasons, wax-coated corrugated cardboard storage containers are generally not considered a sustainable packaging solution. Moreover, previous containers, such as wax-coated or impregnated corrugate cardboard, or wood, are often too heavy, which translates into fewer products being shipped. This increases receiver and consumer costs, as well as increasing fuel and freight expense.

Consistent with embodiments disclosed herein, plastic containers may be utilized to store produce. In some embodiments, such containers may comprise corrugated plastic containers. For example, in certain embodiments, the plastic containers disclosed herein may be configured to store and/or transport corn. Utilizing plastic containers offers certain benefits over conventional wood crates, wire crates, and/or wax-coated corrugated cardboard storage containers to store corn. For example, corrugated plastic containers configured to store corn consistent with embodiments disclosed herein may be assembled more quickly, may be generally lighter, may be less prone to causing injuries, may be generally more durable (especially through demanding harvesting, packing, post-harvest cooling, and shipping processes), may be may be recyclable or otherwise more sustainable, may resist mold growth, may provide certain container labeling and/or marking benefits, and/or may provide an improved sterile environment for packing fresh produce.

Figure 1:
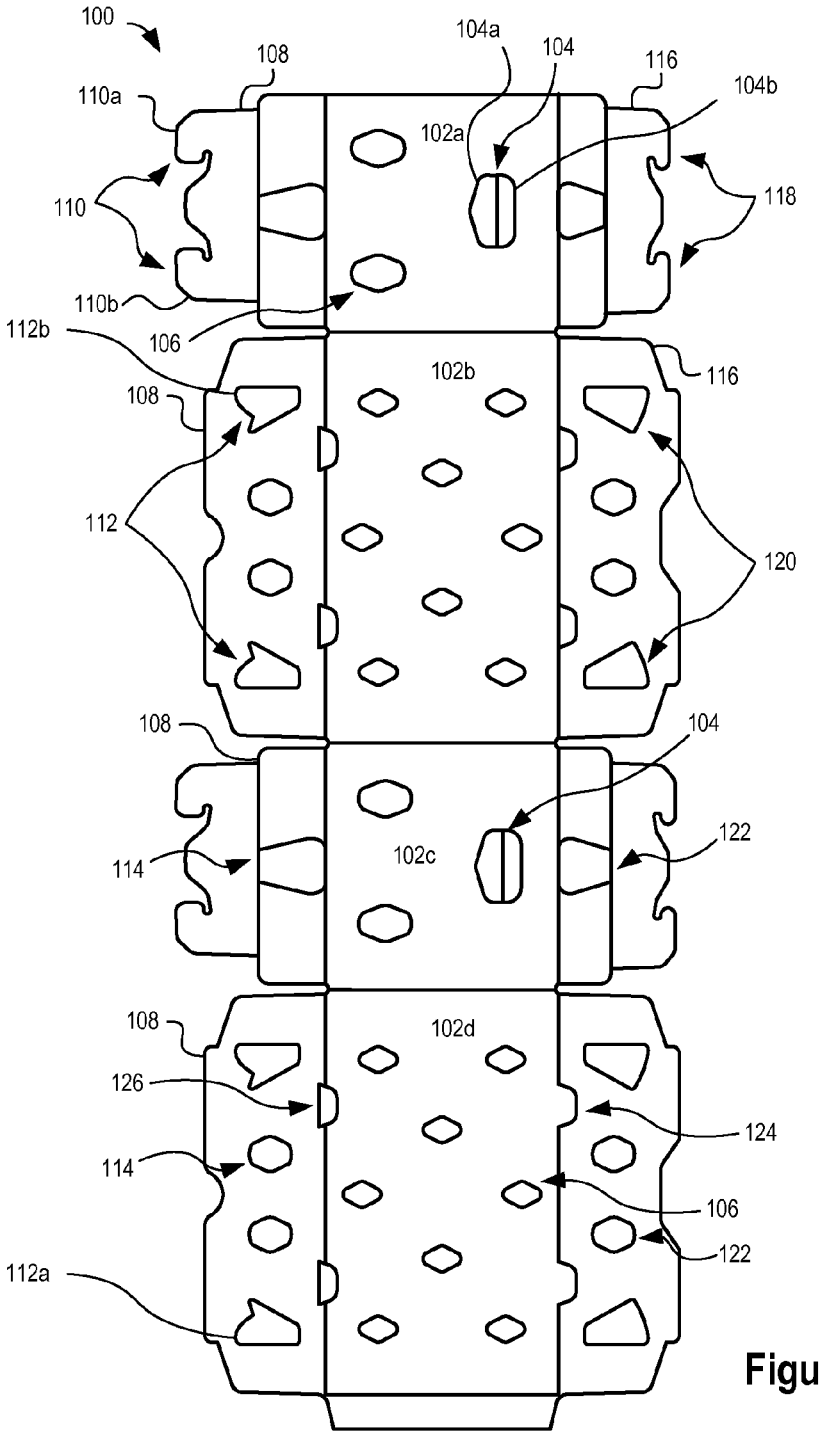
FIG. 1 illustrates a design for a plastic produce container consistent with embodiments of the present disclosure.

FIG. 1 illustrates a design for a corrugated plastic produce container 100 consistent with embodiments of the present disclosure. The produce container 100 may be comprised of a corrugated plastic material that, in some embodiments, may comprise an extruded polypropylene material having a Society of the Plastics Industry ("SPI") recycling number of 5, although other suitable plastic materials may be utilized instead of, or in addition to, polypropylene material. In certain embodiments, the corrugated plastic material may be dyed to a desired color. In further embodiments, the corrugated plastic material may be lightly colored (e.g., colored white) to reflect sunlight and absorb less heat.

In some embodiments, the corrugated plastic material may serve as an improved medium for receipt of an adhesive label, ink, and/or other similar marking thereto, thereby allowing the produce container 100 to be marked by a user as desired (e.g., with content marking, food safety traceability, corporate marking, and/or the like). In further embodiments, the corrugated plastic material may be marked by "branding" the material with a heat source.

As illustrated, the produce container 100 may comprise one or more substantially planar sheets of corrugated plastic material that may be folded or otherwise assembled into a three-dimensional container. The use of substantially planar sheets may allow for a large number of unassembled produce containers 100 to be stacked and transported in a relatively low volume of space (e.g., 22,000 containers per truck load vs. 12,500 conventional wood and wire crates per truck). In some embodiments, the sheet(s) of corrugated plastic material may be die cut. In certain embodiments, the produce container 100 may be assembled into a three-dimensional container without the use of adhesives or other bonding techniques (e.g., heat welding and the like). Further embodiments, however, may utilize adhesives or other bonding techniques in assembling the produce container 100.

The produce container 100 may comprise a sheet portion comprising one or more sides 102. The sheet portion comprising the sides 102 may comprise one or more folding lines that may be used to fold and/or otherwise assemble the sides 102 to form in part a three-dimensional box comprising four sides. In certain embodiments, the folding lines may comprise one or more creases or scores in the corrugated plastic material configured to allow a user to more easily fold and/or assemble the sides 102 to form a box.

One or more of the sides 102*a*, 102*b*, 102*c*, and 102*d* may comprise one or more handle structures 104. For example, in the depicted embodiment, sides 102*a* and 102*c* both comprise a handle structure 104. When the produce container 100 is assembled, the handle structures 104 may be configured to form one or more handles that may allow a user to easily pick up the produce container 100. And, in some embodiments, the still connected flap of the handle may protect users' hands when picking up the containers and/or may otherwise make handling of the containers more comfortable. In some embodiments, the handle structures 104 may be positioned such that they are disposed on opposing sides of the produce container 100 when assembled. In certain embodiments, the produce container 100 may comprise one or more structural members and/or elements (not shown) that may increase the structural integrity of the produce container 100 when the produce container 100 is lifted using one or more handles formed by the handle structures 104. For example, the areas forming handle structures 104 may comprise extra layers of materials and/or different types of materials to provide for added structural integrity in those areas.

Indeed, as illustrated in FIG. 1, planar sheet 100 comprises two handle structures 104 configured so as to be positioned on opposing sides of a three-dimensional box formed from sheet 100 after it has been folded into such a box. Moreover, handle structures 104 each comprises an opening portion 104*a* and a handle member portion 104*b*. Handle opening portion 104*a* is configured to allow a user to insert at least a portion of his or her hand therethrough and handle member portion 104*b* is configured to allow a user to grip handle member portion 104*b* to lift and/or carry the completed box.

Handle member portion 104*b* may, in some embodiments, comprise extra layers of materials and/or different types of materials to provide for added structural integrity. In some embodiments, handle member portion 104*b* may comprise, for example, a more flexible material or a material that otherwise allows the handle to extend in a direction away from the completed box to provide further ease of use during handling.

The sides 102 may further comprise one or more vent openings 106. The vent openings 106 may be configured to allow air and/or moisture to pass in and out of the produce container 100 when the container is assembled and closed. In certain embodiments, allowing for venting of the produce container may help to reduce the likelihood of food (e.g., corn) spoilage.

The produce container 100 may comprise portions comprising one or more bottom flaps 108. The bottom flaps 108 may attached to respective sides 102 of the produce container 100 via one or more folding lines that may be used to fold and/or otherwise articulate the bottom flaps 108 relative to the sides 102 to form in part a three-dimensional box comprising four sides and a bottom. The folding lines may comprise one or more creases or scores in the corrugated plastic material configured to allow a user to more easily fold and/or assemble the bottom flaps 108 to form a box.

Certain of bottom flaps 108 may comprise bottom tabs 110. The bottom tabs 110 may be configured to be received and secured within one or more bottom tab receiving openings 112 included on bottom flaps 108 located adjacent to the bottom tabs 110 when the produce container 100 is being assembled. In certain embodiments, the bottom tabs 110 may be hook-shaped to improve the ability of the bottom tabs 110 to be received and secured in corresponding bottom tab receiving openings 112. In further embodiments, the design of the bottom tabs 110 and the bottom tab receiving openings 112 may improve the ease of assembly of the produce container 100.

For example, as illustrated, bottom flaps 108 comprising bottom tabs 110 may extend from the sides 102 of the produce container 100 further than bottom flaps 108 comprising bottom tab receiving openings 112. In certain embodiments, lengthening the bottom flaps 108 comprising bottom tabs 110 relative to the bottom flaps 108 comprising bottom tab receiving openings 112 may provide for a stronger and more secure bottom to the produce container 100 when assembled, thereby improving the ability of the produce container 100 to store and/or transport heavier loads.

In addition, in the depicted embodiment, bottom flaps 108 comprising bottom tabs 110 may extend from the sides 102 of the produce container 100 further than other flaps that make up produce container 100, such as top flaps 116. In some embodiments, at least one, or in some embodiments both, of bottom tabs 110 may extend from sides 102 further than any other tabs/flaps in the entire sheet 100. In alternative embodiments, however, top flaps 116 may comprise one or more of the features discussed herein vis-à-vis bottom flaps 108, including for example the notched openings discussed in greater detail below and/or the tabs that extend beyond the distance with which other tabs extend.

In the depicted embodiment, each of tabs 110 comprises a first tab portion 110*a* and a second tab portion 110*b*, each of which is configured to extend into and interlock with an adjacent tab receiving opening 112. More particularly, second tab portion 110*b* is configured to extend into and interlock with tab receiving opening 112*b* and first tab portion 110*a* is configured to extend into and interlock with tab receiving opening 112*a* (extending from side 102*d*). Although in the depicted embodiment, tab portions 110*a* and 110*b* are part of a single tab 110, alternative embodiments are contemplated in which the tab portions are entirely separate from one another.

In some embodiments, the bottom flaps 108 may further comprise one or more bottom vent openings 114. The bottom vent openings 114 may be configured to allow air and/or moisture to pass in and out of the produce container 100 when the container is assembled and closed, thereby reducing the possibility of food (e.g., corn) spoilage. In further embodiments, the bottom flaps 108 may comprise one or more further folding lines that may aid a user in assembling the produce container 100 (e.g., securing the bottom tabs 110 into respective bottom tab receiving openings 112). Such folding lines may be scored or otherwise weakened to facilitate the desired folding or such folding lines may simply comprise visual indications of such desired folding locations.

The produce container 100 may further comprise portions comprising one or more top flaps 116. The top flaps 116 may be attached to respective sides 102 of the produce container 100 via one or more folding lines that may be used to fold and/or otherwise articulate the top flaps 116 relative to the sides 102 to form in part a three-dimensional box comprising four sides and a top. The folding lines may comprise one or more creases or scores in the corrugated plastic material configured to allow a user to more easily fold and/or assemble the top flaps 116 to form a box with a top. Alternatively, or additionally, such folding lines may comprise visual markings to illustrate a desired folding location.

Certain of top flaps 116 may comprise top tabs 118. The top tabs 118 may be configured to be received and secured within one or more top tab receiving openings 120 included on top flaps 116 located adjacent to the top tabs 118 when the produce container 100 is being assembled. In certain embodiments, the top tabs 118 may be hook-shaped to improve the ability of the top tabs 118 to be received and secured in corresponding top tab receiving openings 120.

In some embodiments, the top flaps 116 may further comprise one or more top vent openings 122. The top vent openings 122 may be configured to allow air and/or moisture to pass in and out of the produce container 100 when the container is assembled and closed, thereby reducing the possibility of food (e.g., corn) spoilage. In further embodiments, the top flaps 116 may comprise one or more further folding lines that may aid a user in assembling the produce container 100 (e.g., securing the top tabs 118 into respective top tab receiving openings 120).

The produce container 100 may further comprise one or more stacking tabs 124 and/or stacking tab receiving openings 126. In certain embodiments, the one or more stacking tabs 124 may be configured to be received in stacking tab receiving openings 126 associated with another, adjacent produce container 100 when the produce container 100 is assembled. By using the one or more stacking tabs 124 in conjunction with the one or more stacking tab receiving openings 126, aligning assembled produce containers 100 in a stack may be made easier. Moreover, in certain embodiments, aligning assembled produce containers 100 using the stacking tabs 124 and stacking tab receiving openings 126 may allow weight of stacked produce containers 100 to be distributed more evenly and/or across areas of the produce container 100 designed to structurally support certain added weight (e.g., the corners of the assembled produce container 100 and the like). In this manner, larger stacks and/or shipments of produce stored in produce containers 100 may be made. These features may also allow for more efficient use of transport and/or storage space by ensuring that adjacent containers are stacked evenly.

In certain embodiments, the design of the illustrated produce container 100 may be lighter that conventional wood and wire crates (e.g., 1.5 lbs. less than conventional wood and wire crates). The corrugated plastic material used in the produce container 100 may also offer certain advantages when hydrocooling is performed on produce (e.g., corn) stored in the produce container 100. For example, the produce container 100 may move more easily through a hydrocooling system when wet than other similar containers due to a relatively low coefficient of friction of the corrugated plastic material. The disclosed plastic produce container 100 may also gain less weight during a hydrocooling process due to less water absorption in plastic materials as compared to wood containers and/or wax-coated corrugated cardboard containers. In addition, labels and/or other marking adhered to the produce container 100 may experience relatively little deterioration during a hydrocooling process relative to other common materials used for such containers.

Figure 2:
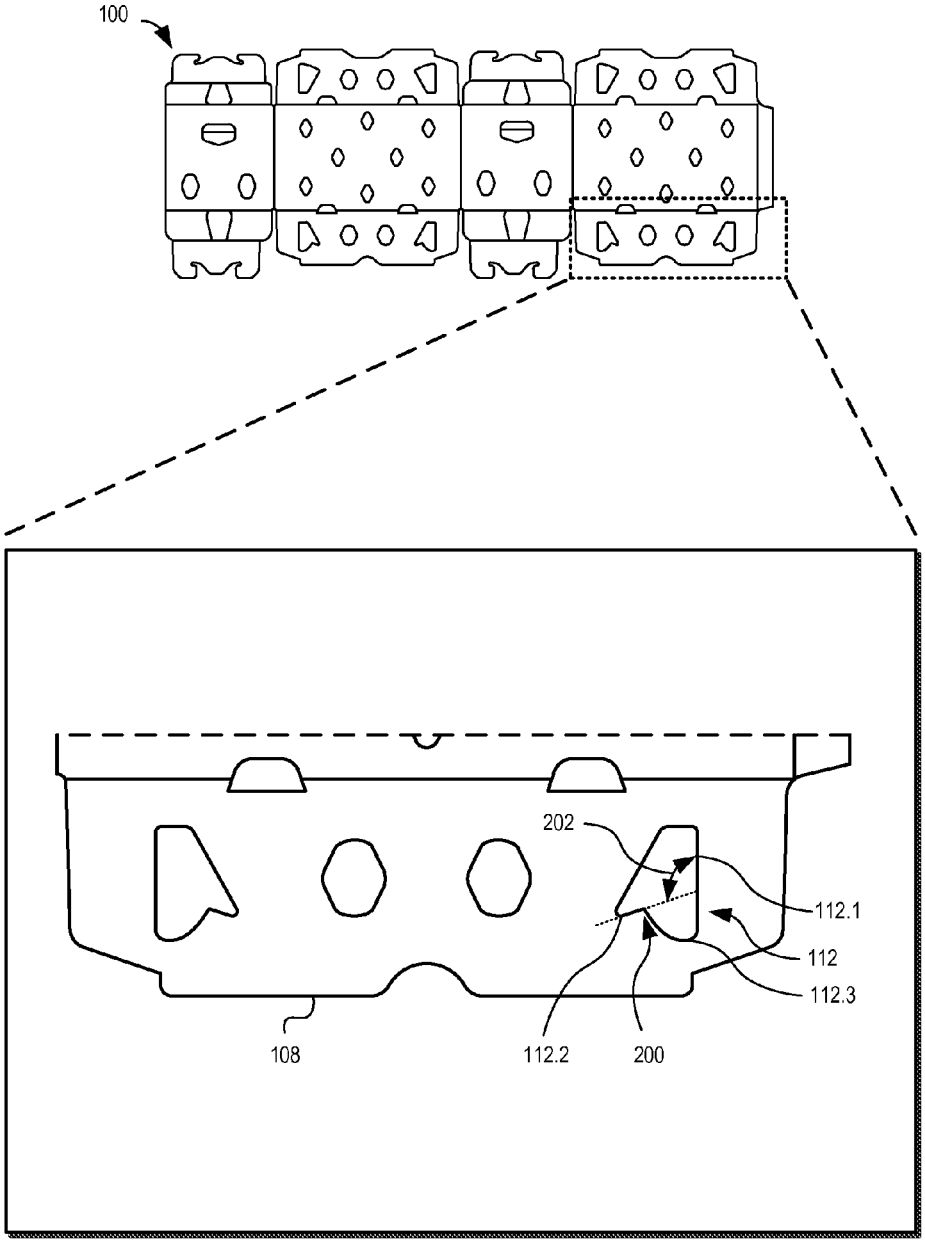
FIG. 2 illustrates an expanded view of certain features of the plastic produce container illustrated in FIG. 1.

FIG. 2 illustrates an expanded view of certain features of the corrugated plastic produce container 100 illustrated in FIG. 1. Particularly, FIG. 2 illustrates certain features associated with a bottom tab receiving opening 112 located on a bottom flap 108. As illustrated, one or more of the bottom tab receiving openings 112 may comprise a side 112.1 that is substantially perpendicular to the folding lines between sides 102*a*, 102*b*, 102*c*, and 102*d*. A side of bottom tab receiving opening 112 adjacent to side 112.1 may define an indention 200 (e.g., a notch). In certain embodiments, the indention 200 may be configured to facilitate a secure connection with bottom tab 110 when bottom tab 110 is received within the bottom tab receiving opening 112. For example, in certain embodiments, a side of the indention 200 may be disposed to extend relative to side 112.1 of the bottom tab receiving opening 112 at an angle 202 that is greater than 90°. In some embodiments, the angle 202 may be an angle that improves the securement of the bottom tab 110 within the bottom tab receiving opening 112 without substantially reducing the ease of assembly of the produce container 100. In some embodiments, angle 202 may be between about 91° and about 100°. In some such embodiments, angle 202 may be between about 92° and about 98°. In some such embodiments, angle 202 may be about 95°.

In addition, as also best illustrated in FIG. 2, notch 200 may, in some embodiments, be configured to comprise at least one side that extends at angle 202 along an at least substantially straight line towards the outermost side 112.1 of the bottom tab receiving opening 112. Notch 200 may further comprise a concave, curved line side that extends towards and ultimately joins with the outermost side 112.1 of the bottom tab receiving opening 112, as also illustrated in FIG. 2.

On both opposite sides of notch 200, bottom tab receiving opening 112 comprises a lobe. More particularly, a first lobe 112.2 is positioned on the left side of notch 200 (from the perspective of FIG. 2) and a second lobe 112.3 is positioned on the right side of notch 200. As can be seen in FIG. 2, both lobes are rounded. However, lobe 112.3 extends further from a central axis of the respective sides 102*a*, 102*b*, 102*c*, and 102*d* than does lobe 112.2. Moreover, lobe 112.2 is angled inwardly. In the depicted embodiment, lobe 112.2 is defined by a first side that, as described above, extends at angle 202 towards side 112.1. Lobe 112.3 is further defined by a second side that also extends at an angle relative to side 112.1. However, the angle at which the first side extends relative to side 112.1 is substantially steeper (viewed as the complementary angle to angle 202) than the angle at which the second side extends relative to side 112.1.

It will be understood by those having skill in the art that changes may be made to the details of the above-described embodiments without departing from the underlying principles presented herein. In addition, any suitable combination of various embodiments, or the features thereof, is contemplated.

Any methods disclosed herein may comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, inventive aspects lie in a combination of fewer than all features of any single foregoing disclosed embodiment.

Those having skill in the art will therefore appreciate that many changes may be made to the details of the above-described embodiments without departing from the underlying principles of the invention. The scope of the present invention should, therefore, be determined only by the following claims.

The invention claimed is:

1. A substantially planar sheet for folding into a container, comprising:

a first side portion comprising opposing flaps positioned on opposite sides of the first side portion, wherein the opposing flaps of the first side portion each comprises at least one tab extending therefrom;

a second side portion positioned adjacent to the first side portion and comprising opposing flaps positioned on opposite sides of the second side portion, wherein the opposing flaps of the second side portion each comprises at least one tab receiving opening configured to receive a tab from the first side portion, wherein the second side portion further comprises at least one stacking tab and at least one stacking tab receiving opening, and wherein at least one of the tabs of the first side portion extends further from the first side portion than an adjacent flap of the second side portion;

a third side portion positioned adjacent to the second side portion and comprising opposing flaps positioned on opposite sides of the third side portion, wherein the opposing flaps of the third side portion each comprises at least one tab extending therefrom; and a fourth side portion positioned adjacent to the third side portion and comprising opposing flaps positioned on opposite sides of the fourth side portion, wherein the opposing flaps of the fourth side portion each comprises at least one tab receiving opening configured to receive a tab from the third side portion, wherein the sheet is configured to be folded into a three-dimensional container, wherein the at least one stacking tab is configured to be positioned within a stacking tab receiving opening of an adjacent container after the sheet has been folded into a three-dimensional container, and wherein the at least one stacking tab receiving opening is configured to receive a stacking tab of an adjacent container after the sheet has been folded into a three-dimensional container.

2. The sheet of claim 1, wherein the container comprises a corrugated plastic container.

3. The sheet of claim 1, wherein the sheet further comprises:

a first folding line positioned between the first side portion and the second side portion;

a second folding line positioned between the second side portion and the third side portion; and a third folding line positioned between the third side portion and the fourth side portion.

4. The sheet of claim 3, wherein each of the folding lines comprises a score line configured to facilitate folding along each of the folding lines.

5. The sheet of claim 1, wherein the sheet is configured to be folded into a three-dimensional container without the use of any adhesives or other bonding techniques.

6. The sheet of claim 1, wherein the sheet further comprises a first handle structure and a second handle structure.

7. The sheet of claim 6, wherein the first handle structure is positioned on a side portion of the sheet opposite from a side portion of the sheet on which the second handle structure is positioned.

8. The sheet of claim 7, wherein the first handle structure comprises a first handle opening portion and a first handle member portion, and wherein the second handle structure comprises a second handle opening portion and a second handle member portion.

9. A corrugated produce box, comprising:

a first flap comprising a first tab extending from the first flap;

a side portion defining a side of the box; and a second flap adjacent to the first flap and comprising a first tab receiving opening configured to receive the first flap, wherein the first tab receiving opening comprises an indentation, wherein the indentation comprises a first side extending along an at least substantially straight line towards an outer side of the first tab receiving opening at an angle with respect to the outer side of the first tab receiving opening, wherein the outer side of the first tab receiving opening extends at least substantially perpendicular to a fold between the second flap and the side portion, and wherein the angle is greater than ninety degrees.

10. The corrugated produce box of claim 9, wherein the indentation is configured to facilitate improved securement of the first tab within the first tab receiving opening.

11. The corrugated produce box of claim 9, wherein the angle is between about 91 degrees and about 100 degrees.

12. The corrugated produce box of claim 11, wherein the angle is between about 92 degrees and about 98 degrees.

13. The corrugated produce box of claim 12, wherein the angle is about 95 degrees.

14. The corrugated produce box of claim 9, wherein the indentation comprises a notch.

15. The corrugated produce box of claim 9, wherein the outer side comprises a straight line.

16. The corrugated produce box of claim 15, wherein the indentation further comprises a second side adjacent to the first side, wherein the second side comprises a concave, curved line that extends towards and joins with the outer side.

17. A substantially planar sheet for folding into a container, comprising:

a first side portion comprising opposing flaps positioned on opposite sides of the first side portion, wherein the opposing flaps of the first side portion each comprises at least one tab portion extending therefrom;

a second side portion positioned adjacent to the first side portion and comprising opposing flaps positioned on opposite sides of the second side portion, wherein the opposing flaps of the second side portion each comprises at least one tab receiving opening configured to receive a tab portion of the first side portion therein, and wherein at least one of the tab portions of the first side portion extends further from the first side portion than an adjacent flap of the second side portion;

a third side portion positioned adjacent to the second side portion and comprising opposing flaps positioned on opposite sides of the third side portion, wherein the opposing flaps of the third side portion each comprises at least one tab portion extending therefrom; and a fourth side portion positioned adjacent to the third side portion and comprising opposing flaps positioned on opposite sides of the fourth side portion, wherein the opposing flaps of the fourth side portion each comprises at least one tab receiving opening configured to receive a tab portion from the third side portion therein.

18. The sheet of claim 17, wherein at least one of the tab portions of the third side portion extends further from the third side portion than an adjacent flap of the fourth side portion.

19. The sheet of claim 17, wherein a first tab portion of the first side portion extends further from the first side portion than an adjacent flap of the second side portion, and wherein a second tab portion extending from an opposite side of the first side portion relative to the first tab portion does not extend further from the first side portion than an adjacent flap of the second side portion.

20. The sheet of claim 19, wherein a first tab portion of the third side portion extends further from the third side portion than an adjacent flap of the fourth side portion, and wherein a second tab portion extending from an opposite side of the third side portion relative to the first tab portion of the third side portion does not extend further from the third side portion than an adjacent flap of the fourth side portion.

* * * * *